United States Patent [19]

Muller

[11] Patent Number: 4,641,362

[45] Date of Patent: Feb. 3, 1987

[54] PROTECTIVE DISPENSING ASSEMBLY FOR ULTRAPURE LIQUIDS

[75] Inventor: Charles B. Muller, Houston, Tex.

[73] Assignee: C. Muller & Associates, Inc., Houston, Tex.

[21] Appl. No.: 664,854

[22] Filed: Oct. 25, 1984

[51] Int. Cl.[4] ..... B65D 30/10

[52] U.S. Cl. ..... 383/115; 383/113; 383/904; 383/906; 604/408

[58] Field of Search ..... 383/904, 906, 107, 115, 383/113, 9; 220/403, DIG. 7, 410; 229/75; 215/24 G; 24/90 HA; 493/213, 929; 604/408–414, 415

[56] References Cited

U.S. PATENT DOCUMENTS

| | | | |
|---|---|---|---|
| 2,698,619 | 1/1955 | Beacham et al. | 383/9 X |
| 3,042,086 | 7/1962 | Winchell | 604/408 X |
| 3,827,591 | 8/1974 | Spelman et al. | 215/246 X |
| 4,212,299 | 7/1980 | Yokokoji et al. | 604/408 |
| 4,346,710 | 8/1982 | Thanawalla et al. | 604/408 |
| 4,415,393 | 11/1983 | Grimes | 604/415 X |
| 4,482,585 | 11/1984 | Ohodaira et al. | 604/408 X |

FOREIGN PATENT DOCUMENTS

| | | | |
|---|---|---|---|
| 686219 | 5/1964 | Canada | 604/415 |
| 861466 | 2/1961 | United Kingdom | 604/408 |

*Primary Examiner*—William Price

*Assistant Examiner*—Bryon Gehman

[57] ABSTRACT

A protective dispensing assembly for ultrapure liquids which comprises an outer protective enclosure containing a flexible liquid container composed of fluorocarbon material which is inert and will not contaminate ultrapure liquid contained therein. The flexible dispensing container within the protective enclosure is formed by heat sealing a pair of fluorocarbon sheets so as to form an internal chamber for containing the liquid. The sheets form a bottom opening which receives a length of fluorocarbon tubing having its upper end in communication with the internal chamber. The sheets of the flexible container each form tab members located below the bottom opening of the container which are wrapped in overlapping manner about the fluorocarbon tubing and are heat sealed to form a tubing/container connection having efficient structural integrity. For further strength, a heat shrink sleeve is positioned about the wrapped tab members and is also heat sealed to the tab members and tubing. The protective enclosure, which is defined by two interfitting halves, provides protection for the flexible container such as during shipping and handling and also prevents light from degrading the material within the container. The protective enclosure also provides support for the container during use and exposes the outlet tubing of the container to thus permit dispensing of the liquid material while the protective enclosure remains closed.

11 Claims, 7 Drawing Figures

PROTECTIVE DISPENSING ASSEMBLY FOR ULTRAPURE LIQUIDS

FIELD OF THE INVENTION

This invention relates generally to a system for handling, shipping and dispensing ultrapure liquid material, such as water, solvents, etc., such as for use in critical laboratory analysis, to thus ensure against contamination of the liquid material prior to its intended use.

BACKGROUND OF THE INVENTION

This invention relates to a packaging and dispensing container system including a flexible dispensing container which is constructed of a noncontaminating fluorocarbon or fluorinated hydrocarbon material such as fluorinated ethylene propylene (FEP) material and which is used for the packaging and storage of high purity solutions and solvents which are used in the medical, biomedical and industrial research laboratories for performing critical chemical analyses of various chemical and biological materials.

One of the objects of this invention is to provide a package which does not contaminate various solvents which have been produced by distillation to an ultra-high purity. The present method of packaging these solvents is by placing them in glass bottles, which, in itself, has been found to have a tendency to contaminate the materials in the glass bottles by a process of leaching out the impurities in the glass container.

Another object of the invention is to provide a dispensing package for high purity liquids which does not require the opening of the container, such as by unscrewing a cap as is conventionally done, to dispense the packaged solvents or solutions. The presently used methods of packaging the aforementioned solvents or solutions requires the user or researcher to open a bottle by unscrewing a cap, thus breaking the seal. This allows contaminating ambient atmosphere to immediately enter the package thus contaminating the materials therein contained with dust and various gasses contained in the ambient atmosphere. Also, as the solvents or solutions are poured out of the usual dispensing bottle, which in some cases exposes the user to toxic and noxious materials, the volume of the solution in the bottle is diminished and is replaced by a like volume of the contaminating ambient atmosphere in which the container is located, thus further contaminating the high purity materials remaining in the bottle. For this reason a significant quantity of expensive high purity liquid is lost to excessive contamination rendering it unsuitable for use.

Another object of the invention is to allow the user to open a dispensing container a maximum of one time to permit dispensing of the contained materials over an extended period of time. According to the present invention, after the fluorocarbon plug sealing the outlet tube is removed, the user places a stopcock type valve, which is manufactured of non-contaminating perfluoro alkoxyl (PFA) material, on the open end of the outlet tube by means of a compression fitting, which is a molded integral part of the stopcock thus again closing the outlet tube against invasion of the ambient atmosphere. The package is now ready to dispense the high purity liquid by suspending the package at an elevated position by means of a supporting rod such as the support arm of a conventional IV stand. To dispense the liquid, the user may open the valve and dispense the liquid material directly into a container which has been prepared to receive the liquid, or the user may attach a non-contaminating length of fluorocarbon tubing such as polytetrafluoroethylene (PTFE), FEP or PFA tubing to the opposite end of the stopcock valve and deliver the liquids to any part of the laboratory without contaminating the ultrapure liquid and with a minimum of exposure to the user to possible toxic or noxious materials such as some ultrapure solvents.

Another object of the invention is to provide for easy dispensing of the packaged liquid from a flexible container by utilizing ambient atmospheric pressure to cause collapsing of the flexible container as the liquid is dispensed and thus utilizing sufficient hydrostatic pressure to dispense the materials without exposure to the atmosphere and contaminating the purity of the liquid being dispensed, as well as ensuring minimal exposure of the user to possible noxious or toxic vapors.

Another object of this invention is to provide a chemically inert package for controlled dispensing of intravenous solutions to medical patients who require medications via a needle placed in a vein and a length of chemically inert tubing placed between the flexible container and the needle. Current flexible containers used in the medical field for intravenous application are typically fabricated from vinyl chloride to produce a "vinyl" bag. This material, which contains vinyl chloride, could be a possible source of vinyl chloride particulate matter, which is a suspected carcinogenic hazard to medical patients. This vinyl chloride particulate is liberated from the bag material due to its chemical instability and could enter the human body along with the intravenous solution via the connecting tubing and the needle placed in the vein of the patient. Also, the silk screen printing on the outside of the vinyl bag has a tendency to permeate through the thin PVC sheet material, thus entering trace quantities of ink into the intravenous solution and consequently into the human body via the intravenous connection.

For protection of the flexible FEP container of this invention, which is relatively fragile due to the relative inflexibilities of fluorocarbon construction material, a protective outer enclosure, such as may be composed of expanded polyurethane may be employed to provide external support for the outer seams of the container as well as the basic wall structure of the flexible container.

The outer package is utilized to provide container stability and to prevent possible rupture of the heat sealed seams of the flexible container during shipment and use. The protective outer enclosure is typically injection molded to provide an internal cavity conforming to the shape of the flexible container when it is filled with solution, thus giving maximum protection and cushioning during the handling of the package during shipment, storage and use.

Another object of the invention is to provide a protective enclosure capable of preventing light penetration into the liquid material within the flexible container. Some solvents or materials to be packaged in the container might be light sensitive and could become degraded due to exposure to light. By coating the inside of the expanded polyurethane protective enclosure or outer package with a light-blocking material, such as a water base black paint or black vinyl sheeting or any other light blocking material, the bag contained within the protective enclosure is never exposed to light to possibly degrade the materials contained therein.

Another object of the protective enclosure is to prevent the outlet tube, which is connected to the FEP container, from being forced into the container and possibly rupturing the container. A frangible protective tube, such as may be constructed of heavy paper, cardboard or of any other suitable material, is scored to provide easy breaking when the package is to be used to dispense the contained liquids. This protective tube will have a flare or flange on the end fitting into the expanded polyurethane protective enclosure, which will have a receiving ring to accept the flanged or flared end. When the two halves of the protective enclosure are placed together, they will secure the protective sleeve in assembly with the protective enclosure.

Another object of the outer package is to provide a surface on which identifying labels may be placed. Since few adhesive materials will adhere to the FEP material from which the flexible containers are fabricated, the protective enclosure will provide an appropriate receptacle for identifying labels.

Another object of this invention is to provide a protective enclosure having support structure enabling the enclosure to provide the bag and its contents to be suspended as a dispensing unit from a support rod. In some instances, the protective enclosure may define support tabs having support apertures permitting its support by a support rod. For support of the flexible container without the protective enclosure, the flexible bag may define an upper support tab having an aperture receiving a support arm. In such case the grommeted tail of the bag may have its structural integrity weakened by placing a grommet through the hole provided in the end of the bag, especially when larger capacity bags are employed. By having an injection molded extension on each half of the end of the outer package and those extensions having grommets placed in holes in the extensions, the entire protective enclosure including the FEP container and its materials may be suspended from a supporting rod, thus preventing external and internal forces from causing the bag to rupture.

Another feature afforded by the protective enclosure is to provide for easy storage of the unit on laboratory shelf space. The flat surfaces allow the user to stack the containers one on top of the other to take up a minimal amount of available shelf space, which, in most laboratories, is at a premium.

Another object of the outer package is to provide for color coding the package to identify the solvents or liquids contained therein. By providing the protective dispensing tube sleeve extended from the expanded polyurethane protective enclosure in various colors relating to the contents, it is easier for the user to identify the material contained in the package.

Another feature of the outer protective enclosure package is to provide injection molded grooves n the outer surface of the expanded polyurethane material to allow the use of strapping materials to secure the two halves of the outer package in assembly. By use of strapping materials, enough force may be exerted on the outer surface to force the enclosure halves tightly together to provide proper support to the FEP bag and its contents.

Another feature of the outer package is to allow for identification of the materials which were previously contained in an amply flexible container, so that the flexible container may be refilled with the same material. Since FEP material does have a certain limited permeability, to reuse the flexible container one must identify the material previously packaged in the container. By identifying the material previously contained, there is a possibility of refilling the bag with the same solvent thereby preventing any cross-contamination that might otherwise occur.

Another feature provided by the outer package is visual identification of the integrity of the package. Should there by any punctures, tears or holes in the outer package, there is a possibility or probability that the inner FEP container is also ruined, thus eliminating the possibility of reuse.

BRIEF DESCRIPTION OF THE DRAWINGS

So that the manner in which the above-recited features, advantages and objects of the invention, as well as others which will become apparent, are attained and can be understood in detail, a more particular description of the invention, briefly summarized above, may be had by reference to the embodiments thereof illustrated in the appended drawings, which drawings form a part of this specification.

It is to be noted, however, that the appended drawings illustrate only typical embodiments of this invention and are not to be considered limiting of its scope, for the invention may admit to other equally effective embodiments.

In the Drawings:

FIG. 1 is a view illustrating a fluorocarbon sheet blank employed in the fabrication of a flexible container according to this invention.

FIG. 2 is a similar view illustrating a fluorocarbon sheet blank which is substantially identical to the sheet blank of FIG. 1 and is positioned in mirror image relation thereto upon assembly.

FIG. 3 is a partial sectional view in elevation showing a flexible container constructed in accordance with the present invention from fluorocarbon sheet blanks such as shown in FIGS. 1 and 2.

FIG. 4 is a fragmentary sectional view of the flexible container construction of FIG. 3 showing the connection of fluorocarbon tubing to the fluorocarbon sheet material of the container.

FIG. 5 is a fragmentary elevational view of the upper portion of the flexible container representing an alternative embodiment of the present invention wherein the flexible container is provided with a support tab.

FIG. 6 is a fragmentary elevational view of the upper portion of a flexible container representing another embodiment of this invention.

FIG. 7 is an isometric illustration of an external protective enclosure structure with the two halves thereof being separated to show the interior.

DETAILED DESCRIPTION OF PREFERRED EMBODIMENT

Figure 1:
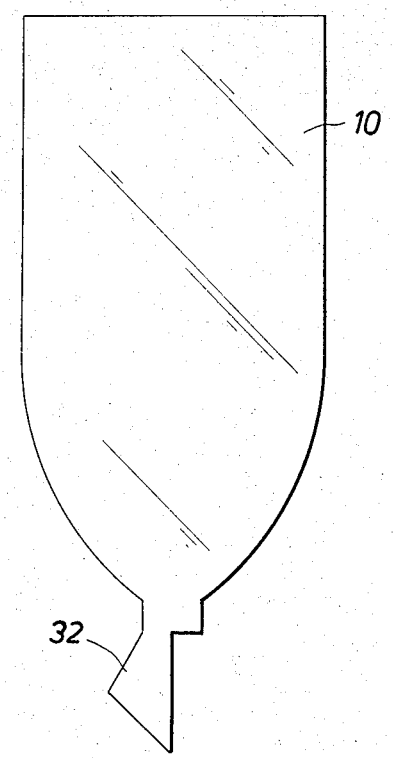
Figure 2:
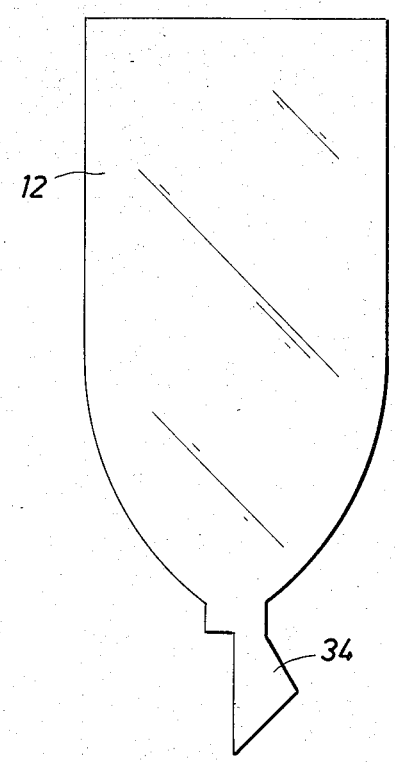

Referring now to the drawings and first to FIGS. 1 and 2, a pair of blanks of sheet material are shown at 10 and 12 which are each composed of an inert polymer material which is stable and will not release impurities into the ultrapure liquid to be in contact therewith. The sheet blanks 10 and 12 may be composed of any one of a number of commercially available fluorocarbon materials, such as polytetrafluoroethylene, fluorinated ethylene propylene and the like. Also, it is envsioned that other stable inert sheet materials may be developed in the future which have innate properties satisfying the strict requirements of this invention. It is intended, therefore, that this invention encompass any such materials as well.

Figure 3:
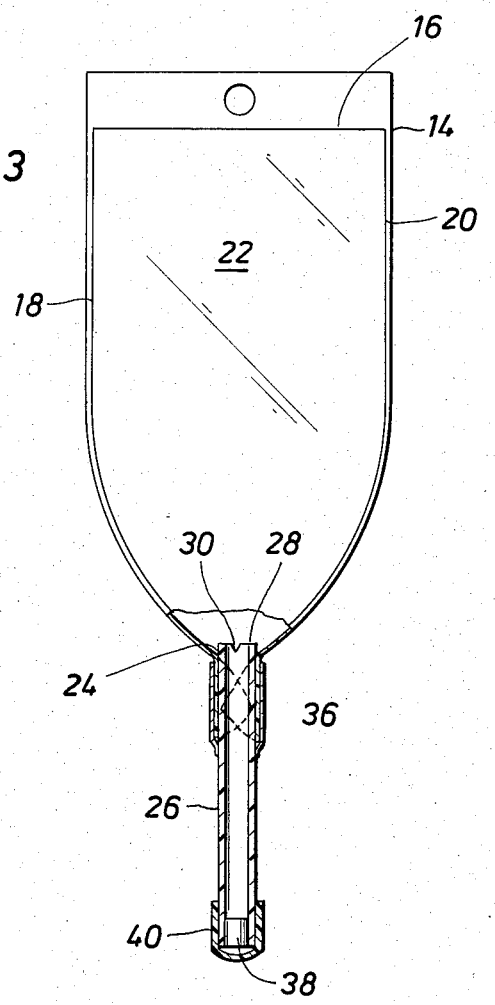
Figure 4:
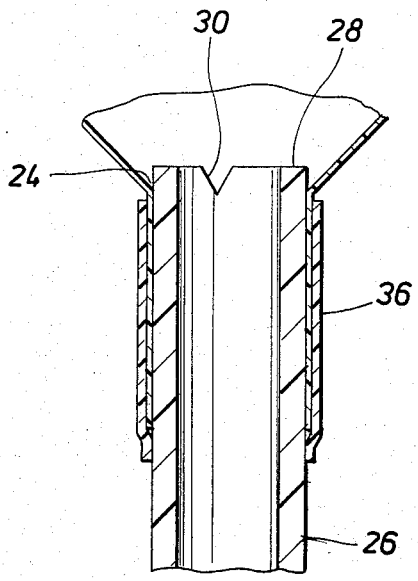

As shown in FIG. 3, the sheet blanks 10 and 12 are assembled to form a flexible container assembly 14 and are heat sealed along the upper extremity, as shown at 16, and along each side, as shown at 18 and 20, thus forming an internal chamber 22 adapted to contain a quantity of ultrapure liquid. The heat seals 18 and 20 at the sides of the flexible container terminate in closely spaced relation defining a bottom outlet opening 24 of sufficient dimension to receive a length of fluorocarbon tubing 26 in close-fitting relation therein. The upper or inner extremity 28 of the tubing 26 extends a short distance into the chamber 22 to thus prevent the sheet material of the flexible container from collapsing and forming a seal at the inner extremity of the tubing. The tubing may also be formed at its inner extremity to define one or more notches 30 which effectively prevent the sheet material of the flexible container from bridging and sealing the upper extremity of the tubing.

As shown in FIGS. 1 and 2, each of the sheet blanks 10 and 12 are provided with lower extending tab portions 32 and 34, respectively, which may be of generally triangular form, as shown, or, in the alternative, may take any other convenient form. After the fluorocarbon dispensing tube 26 has been inserted through the opening 24 to the position shown in the drawings, the tab members 32 and 34 will be disposed in opposed extending relation since the sheet blanks 10 and 12 will simply be superposed and assembled. The tab members will then be wrapped circumferentially about the fluorocarbon dispensing tube to form a connecting structure between the flexible container and the dispensing tube which is of significant structural integrity. After wrapping of the tabs in this manner, the tabs may be heat sealed to the fluorocarbon tube thereby forming an integral, fused assembly between the tabs and tube. The connection thus established between the flexible container and the tube by the wrapped and fused tabs will be leak-free and quite strong.

To further strengthen the connection established by the wrapped tab members 32 and 34, a sleeve 36 formed of heat shrink fluorocarbon material or the like will be positioned about the wrapped tabs either before or after heat sealing of the tab members to the fluorocarbon dispensing tube. Upon application of heat, the heat shrink tube 36 will shrink tightly about the wrapped tab members, thus firmly securing them in place and preventing inadvertent disassembly thereof. If a heat shrink tube is applied about the wrapped tabs prior to heat sealing thereof, a subsequent heat sealing operation will be conducted, thereby fusing the heat shrink tube and the wrapped tabs in integral assembly to fluorocarbon dispensing tube 26. The joint that is thus formed is of significant strength to prevent rupture of the flexible bag assembly during shipping or other handling. Further, significant mechanical forces may be applied to the fluorocarbon tube such as during use, without causing separation thereof from the sheet material from which the flexible container is formed.

After the flexible container has been filled in an inert environment, such as a nitrogen-filled enclosure, the fluorocarbon tube will be sealed at its lower extremity by inserting a fluorocarbon plug 38 therein. The plug 38 will be of such size that it will establish a tight friction fit within the tube to thereby prevent any leakage of the ultrapure liquid from the dispensing tube. The integrity of the friction fit seal of the plug is enhanced by means of a shrink-fit cap member 40, which may also be formed of fluorocarbon material. The shrink-fit cap 40 is positioned about the lower extremity of the dispensing tube 26 and heat is applied to establish a tight, secure fitting relationship thereof with the dispensing tube. Further, if desired, the shrink-fit cap may be fused to the fluorocarbon dispensing tube upon application of sufficient heat for fusing. When dispensing of the ultrapure liquid is desired, the dispensing tube 26 will be severed adjacent the shrink-fit cap to thus opening the tube. A valve element of non-contaminating condition will then be brought into assembly with the dispensing tube, permitting dispensing of the ultrapure liquid under the control of a valve. If desired, the flexible container with its ultrapure liquid may be positioned in any desirable location and an inert flexible dispensing tube downstream of the valve may be extended to any location for desired use. More practically, the flexible container with its ultrapure liquid will be connected to a suitable support, such as a conventional IV stand, such as is typically used in hospitals and laboratories. With the flexible container hanging from the arm of the IV stand, the ultrapure liquid may be dispensed by gravity. If pressure dispensing is desired, the flexible container may be subjected to manual pressure, or, may be enclosed within a pressure-containing vessel, the pressure then being transmitted through the flexible container to the ultrapure liquid.

Figure 5:
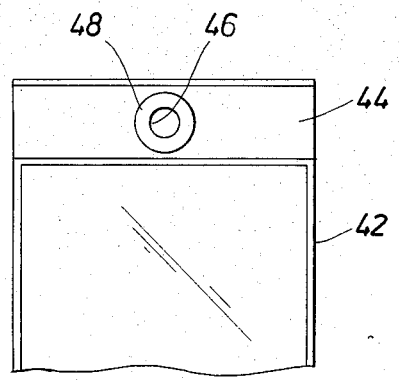
Figure 6:
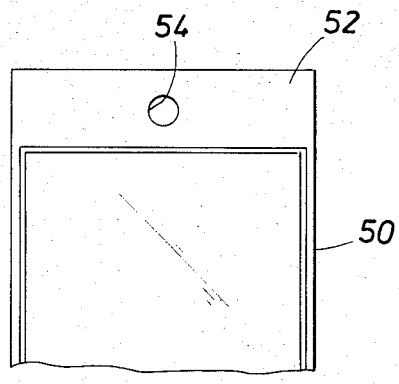

As shown in FIGS. 5 and 6, the upper portion of the flexible container may be provided with structure for support thereof by the arm of a conventional IV stand. As shown in FIG. 5, a flexible container 42 includes an upper support portion 44 defining an aperture 46 which is strengthened by a grommet member 48. More preferably, the grommet member 48 will be formed of a fluorocarbon material as to maintain the inert integrity of the liquid handling and dispensing system. The grommet, however, may take any other convenient form as is appropriate to maintain the noncontaminating integrity of the flexible container.

As shown in FIG. 6, the flexible container 50 includes an upper support portion 52 having an aperture 54 formed therein. The support arm of an IV stand may be simply inserted through either of the apertures 46 and 54 of FIGS. 5 and 6 to thus provide for efficient support of the flexible container and its contents during use.

Figure 7:
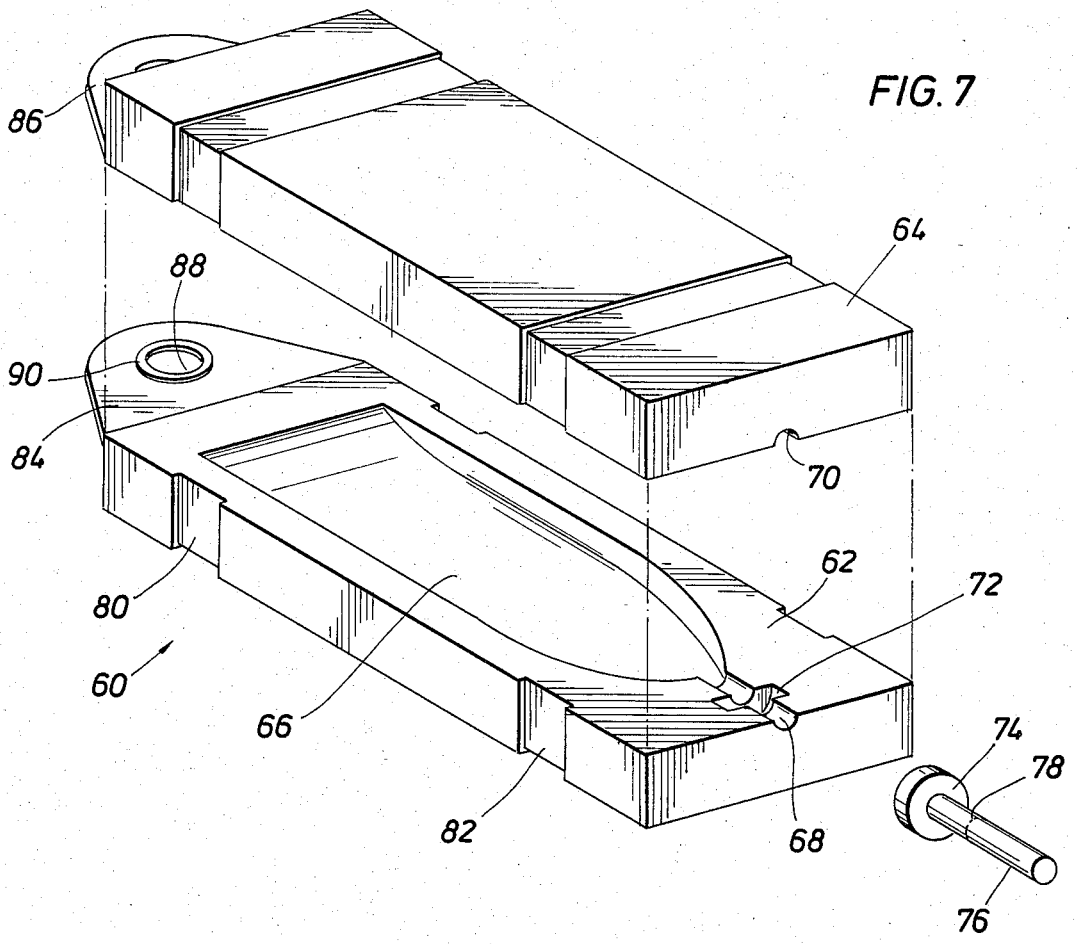

When a liquid-filled, flexible inert container is employed in elevated position, such as shown in FIG. 3, hydrostatic pressure will develop within the container having a pressure which is greater at the lower extremity of the container, adjacent the upper extremity of the dispensing tube 26. When fluorocarbon materials are heat sealed, the seal thus formed is relatively weak, due to the nature of the materials. For this reason, fluorocarbon materials are seldom utilized in the construction of flexible containers and, if utilized, are typically provided with outlet structures composed of other materials having sufficient strength and integrity to withstand a significant amount of pressure and provide the container with structural integrity. These differing materials, however, are not typically inert and the ultrapure quality of the liquid contained within the vessel will be subject to contamination. To overcome the inherent structural weaknesses of flexible containers formed of fluorocarbon materials, a protective enclosure is provided, as shown in FIG. 7. The protective enclosure, which is shown generally at 60, is defined by enclosure sections 62 and 64 which may be of substantially identical configuration. In fact, two molded sections from the same mold may be positioned in mirror image relation to thereby form a protective enclosure for the flexible container of FIG. 3. Each of the protective enclosure sections 62 and 64 will define an internal cavity section such as shown at 66, which cavity section is of corresponding configuration with that of a filled flexible container. Thus, the flexible container will be positioned within the internal cavity defined by the protective enclosure and the wall surfaces of the cavity will provide structural support for the sheet material of the flexible container. The weak seams of the flexible fluorocarbon container will be effectively supported and will withstand severe jarring without rupturing. In some cases, where the ultrapure liquid within the flexible container is subject to decomposition or degradation by light, a light blocking material such as water-base black paint, may coat the cavity surfaces. The paint will block light transfer through the protective enclosure material and thereby protect the ultrapure liquid from light degradation.

Each of the cavity sections 62 and 64 will define an outlet passage groove such as shown at 68 and 70 which cooperate when the sections are in assembly to define a cylindrical passage through which extends the fluorocarbon dispensing tube 26 of a flexible container located within the cavity 66. Thus, the dispensing tube 26 will extend outwardly of the protective enclosure allowing the ultrapure liquid to be dispensed from the flexible container without requiring opening of the protective enclosure. Since, in this condition, the dispensing tube 26 would be exposed, it is desired to provide protection for the dispensing tube during handling and storage. The protective enclosure sections are therefore formed to define recesses 72 which cooperate to receive a circular head portion 74 of a protective sleeve element 76. The protective sleeve element is of sufficient dimension to receive the dispensing tube 26 in protected relation therein. To permit access to the dispensing tube without requiring disassembly of the protective enclosure, the protective sleeve 76 may be perforated about a circular line as shown at 78. By simply flexing the protective sleeve 76, it will fracture at the perforated line 78 and thus the lower portion of the protective sleeve may be easily removed, thereby exposing the lower end of the fluorocarbon dispensing tube 26. The protective sleeve may be color coded to enable identification of the liquid material in the flexible container. Also, for possible refilling of the container, the remaining section of the protective sleeve will remain secured to the enclosure. The container can then be refilled with the same liquid as before without any problem of cross-contamination.

The protective enclosure sections 62 and 64, which may be formed of expanded polyurethane, for example, may be molded to define external strap grooves 80 and 82. With the sections 62 and 64 in assembly, appropriate retainer straps, such as metal bands or flexible plastic straps, may be assembled within the strap grooves 80 and 82 and may be secured to maintain the protective enclosure sections in positive assembly. The retainer bands may be tightened sufficiently to squeeze the enclosure halves in tight assembly, thus providing effective protection for the flexible container enclosed therein. To prevent tampering with the ultrapure liquid within the flexible container, the strap devices may be defined by metal bands or flexible plastic straps which are positively secured in assembly. The enclosure may then be opened only by cutting of the metal or plastic bands. Each of the protective enclosures may also be provided with upper support extensions, such as shown at 84 and 86, each being formed to define an aperture 88 strengthened by a grommet member 90. With the enclosure sections 62 and 64 in assembly, the support extensions 84 and 86 will be in side-by-side engaged relation and the apertures 88 thereof will be in registry. The entire protective enclosure may then be supported by simply extending the support arm of an IV stand through the registering apertures 88.

Since the protective enclosure is of generally rectangular external configuration, efficiency of packaging will be enhanced. The protective enclosures and the flexible container protected ultrapure liquid may be stacked efficiently, such as during transportation and storage. This particular enclosure structure also permits efficiency of handling during use, since the enclosure will stand on its lower end without upper support if an appropriate aperture is provided for receiving the dispensing tube extending downwardly from the lower end of the protective enclosure.

Within the scope of this invention it is contemplated that flexible inert containers for ultrapure liquids may be formed from film tube material as well as from sheet blanks. Again the inert film material, whether of tube or sheet form, will be composed of fluorocarbon material, including any suitable fluorinated hydrocarbon. The lower extremity of the film tube must be cut in such manner as to form opposed wrapping tabs as shown in FIGS. 1 and 2 and a tapered heat seal will be formed such as shown in FIG. 3. The resulting flexible container will, except for side heat seals, be substantially identical to the container illustrated in FIG. 3.

From the foregoing, it is apparent that I have provided a novel inert protective enclosure for containing ultrapure liquids, such as water and solvents, and which is provided with a unique connection between the flexible, protective enclosure and a length of dispensing tube material. The joint that is established between the flexible sheet material of the flexible enclosure and the dispensing tube is structurally enhanced and efficiently withstands a significant amount of rough handling without tearing or otherwise rupturing the fluorocarbon sheet material. The flexible enclosure may be adapted for support by an IV stand or other device or, in the alternative, it may be efficiently supported in a protective enclosure such as may be molded from expanded polyurethane material or the like. Further, the protective enclosure for the flexible container may also provide a part of the dispensing equipment to thereby provide the flexible container with external structural support to prevent rupturing thereof during shipment, storage and handling. Further, dispensing may be accomplished either directly from the flexible container or from a flexible container enclosed within a protective enclosure without necessitating disassembly of the protective enclosure. The protective enclosure also provides an efficient means for positively identifying the liquid within the flexible enclosure contained therein.

It is therefore clearly evident that the present invention is one well adapted to attain all of the objects and advantages hereinabove set forth, together with other objects and advantages that are inherent from a description of the apparatus itself.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof. It is to be understood that all matters hereinabove set forth or shown in the accompanying drawings are to be interpreted as illustrative and not in any limiting sense.

What is claimed is:

1. A flexible inert dispensing container construction for ultra pure ultrapure liquid materials, comprising:

(a) a pair of fluorocarbon sheets disposed in heat sealed assembly with one another and defining an internal chamber for containing ultrapure liquid material, said fluorocarbon sheets cooperatively forming a bottom opening, each of said fluorocarbon sheets forming an integral tab located below said bottom opening;

(b) a length of fluorocarbon tubing extending through said bottom opening and having one end thereof in communication with said internal chamber;

(c) said tabs of each of said fluorocarbon sheets being wrapped peripherally about said fluorocarbon tubing and being of a configuration forming a circumferential overlapping joint with said tubing which is of at least partially spiral-like form; and (d) means securing said tab means in liquid tight assembly with said tubing.

2. A flexible inert dispensing container as recited in claim 1, wherein said securing means comprises:

a sleeve of heat shrink material being positioned about said wrapped tab means for strengthening the assembly of said tab means and said fluorocarbon tubing and applying mechanical compression to said wrapped tab means.

3. A flexible inert dispensing container as recited in claim 2, wherein:

said sleeve of heat shrink material is composed of polymer material.

4. A flexible inert dispensing container as recited in claim 3, wherein:

said fluorocarbon sheets, and said fluorocarbon tubing are composed of polytetrafluoroethylene.

5. A flexible inert dispensing container as recited in claim 2, wherein:

said sleeve of heat shrink material is fused to said tab means and said fluorocarbon tubing by heat sealing.

6. A flexible inert dispensing container as recited in claim 1, wherein:

said fluorocarbon material is polytetrafluoroethylene.

7. A flexible inert dispensing container as recited in claim 1, wherein said tabs comprise:

generally triangular tab elements extending from each of said fluorocarbon sheets each forming an elongated spiral joint about said fluorocarbon tubing.

8. A flexible inert dispensing container as recited in claim 1, including:

(a) a fluorocarbon plug being inserted into the free extremity of said fluorocarbon tubing following filling of said dispensing bag with said ultrapure liquid material and sealing said tubing against leakage; and (b) a cap member composed of heat shrink material covering the free extremity of said fluorocarbon tubing and securing said fluorocarbon plug within said fluorocarbon tubing.

9. A flexible inert dispensing container construction for ultrapure liquid materials comprising:

(a) sheet means composed of substantially inert material forming an internal chamber for containing said ultrapure liquid materials, said sheet means forming a bottom outlet opening;

(b) an outlet tube composed of substantially inert material having a wall thickness greater than the thickness of said sheet means and extending through said bottom outlet opening and having one end thereof in communication with said internal chamber;

(c) at least one tab element being integral with said sheet means and located below and laterally of said bottom outlet opening, said tab element being wrapped peripherally about said outlet tube, and forming a circumferential overlapping joint with said outlet tube said element being of such configuration that said circumferential overlapping joint is of at least partially spiral-like form; and (d) compression means being disposed about said wrapped tab means and mechanically compressing said circumferential overlapping joint to form a liquid tight seal between said wrapped tab means and said outlet tube.

10. A flexible inert dispensing container construction as recited in claim 9, wherein:

said compression means is formed by a length of heat shrink tubing material positioned about said wrapped tab means and contracted by application of heat to mechanically seized compressive relation with said wrapped tab means and said outlet tubing.

11. A flexible inert dispensing container construction as recited in claim 10, wherein:

said wrapped tab means comprises a pair of tabs formed integrally with said sheet means, said tabs being wrapped in a common circumferential direction about said outlet tube such that said circumferential overlapping joint is of generally spiral configuration.

* * * * *